United States Patent [19]

Paulson

[11] Patent Number: 4,631,124

[45] Date of Patent: Dec. 23, 1986

[54] KINETIC GRAVITY DEDUSTER

[76] Inventor: Jerome I. Paulson, 969 Edinburgh Dr., Lancaster, Pa. 17604

[21] Appl. No.: 735,790

[22] Filed: May 20, 1985

Related U.S. Application Data

[63] Continuation-in-part of Ser. No. 495,700, May 18, 1983, abandoned.

[51] Int. Cl.[4] ..... B07B 7/04

[52] U.S. Cl. ..... 209/3; 209/8; 209/39; 209/134; 209/215

[58] Field of Search ..... 209/3, 8, 39, 134, 135, 209/212, 214, 215; 55/3, 5, 131, 132

[56] References Cited

U.S. PATENT DOCUMENTS 3,212,878 10/1965 Bouteille ..... 209/3
3,956,106 5/1976 Muck et al. ..... 209/134 X
3,956,108 5/1976 Young ..... 209/215 X
4,299,693 11/1981 Paulson ..... 209/3

FOREIGN PATENT DOCUMENTS 0570016 2/1959 Canada ..... 209/39
1134941 8/1962 Fed. Rep. of Germany ..... 209/134

*Primary Examiner*—Charles Hart
*Attorney, Agent, or Firm*—Russell J. Egan

[57] ABSTRACT

The subject deduster employs gravity to feed the dust and impurity laden particulate material through a linear kinetic energy cell, which cell generates an electric field to neutralize the static electric charges causing the dust to adhere to the particulate material. With the static electric charge neutralized,the dust can be separated by an air flow substantially transverse to the particle flow. The cleaning can be accomplished by pressurized air or a vacuum. The deduster can include means to collect the dust after it has been separated for the particulate material.

7 Claims, 5 Drawing Figures

KINETIC GRAVITY DEDUSTER

The present invention represents an improvement over my previous U.S. Pat. No. 4,299,693 and is a continuation-in-part of my application Ser. No. 495,700 filed May 18, 1983 and now abandoned.

The present invention represents an improvement over my previous U.S. Pat. No. 4,299,693 and is a continuation-in-part of my application Ser. No. 495,700 filed May 18, 1983 and now abandoned.

It is well known in the art of transporting particulate material that there is a problem of maintaining the purity of the material being transported. This includes removing foreign matter, which may become entrained with the particle flow, as well as maintaining uniform size of the particles. It is quite clear that impurities mixing with the primary material will degenerate the end product quality. It is not as readily appreciated that dust of the same chemical composition as the primary material can also cause a degeneration of the end results. For example, in the field of plastics, particles of different sizes would have different melting temperatures and rates and result in the formation of a non-uniform product. Much of the problem has been caused by the transportation equipment itself breaking the particulate material as it moves through the system.

There have been many attempts to solve the above problems. These include the use of screens and grids to separate the material by particle size. This works to a certain extent, but does not remove the fine dust adhering to the particulate material. Air flows, such as vacuums or air jets, have been directed across or counter to the path of the particulate material with limited success as they only remove the free dust. Other attempts, including my above mentioned patent, have tried to separate the dust by driving the dust laden particles against baffles, with the difference in mass at impact causing separation of the dust from the particulate material. Again, this has had limited success and introduces the possibility of the particulate material breaking at impact thus creating more dust and non-uniform material to be removed.

Magnetic fields have been used to remove material, usually ferrous material, from the main particle flow. However, this would not work for non-magnetic material, such as the plastics material mentioned above.

The present invention overcomes many of the difficulties of the prior art by providing an improved kinetic gravity deduster having three primary features which distinguish it from the prior art. First, it has gravity flow to promote the smooth movement of the solid particulate material with low energy input. Second, it has a linear kinetic field cell to neutralize the static electricity holding the dust to the particulate material allowing the dust to be released from the primary particulate material. Third, a gaseous fluid flow separates the dust from the particulate material to achieve a final product which is substantially uniform in size and free of dust and impurities.

The present invention will now be discussed by way of example with reference to the accompanying drawings, in which.

Figure 2:
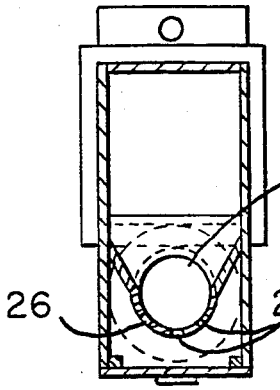
FIG. 2 is a transverse section taken along line 2—2 of FIG. 1.
Figure 3:
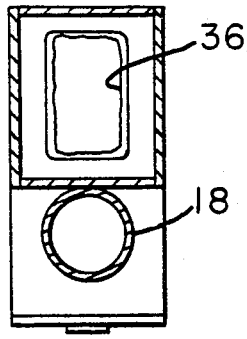
FIG. 3 is a transverse section taken along line 3—3 of FIG. 1.
Figure 1:
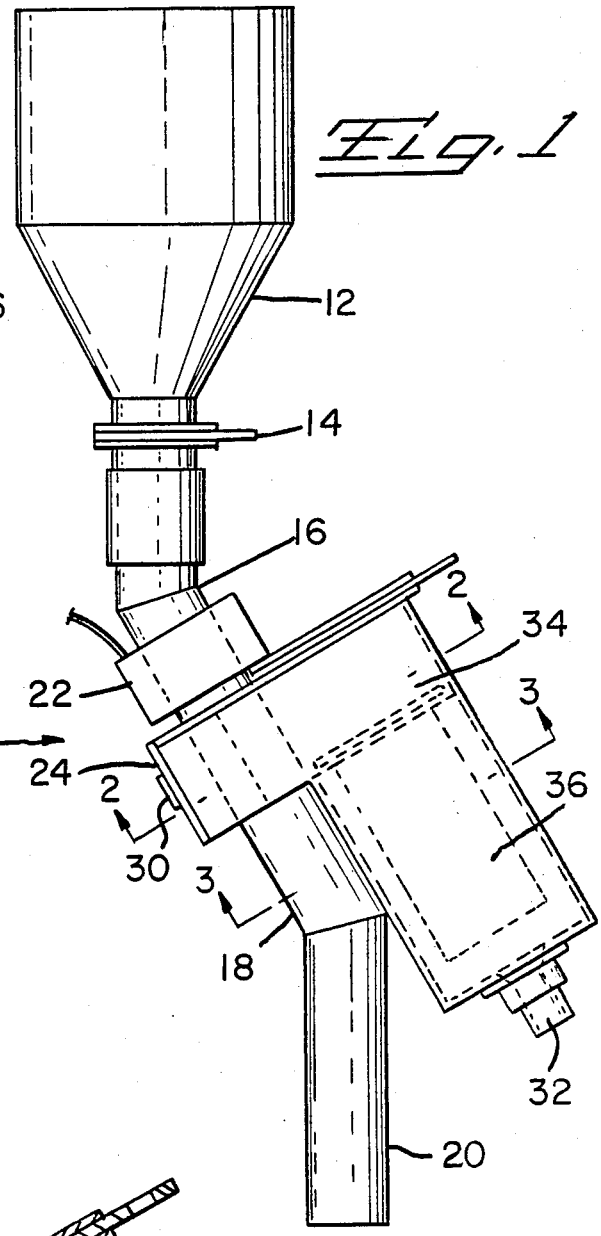
FIG. 1 is a side elevation of a first embodiment of the present invention.

The subject deduster 10 is mounted in a fluent material path beneath a feed hopper 12 having a discharge control 14. The deduster 10 has an input conduit 16 leading through an intermediate conduit 18 to an outlet conduit 20. The conduits 16, 18, and 20 preferably form a vertical zig-zag configuration so that particulate material discharged from the hopper 12 will fall through the deduster 10 by gravity. This configurtion is also space efficient. The conduits 16, 18, and 20 can have any desired cross section, round or square being the most likely shape. The deduster 10 includes a linear kinetic cell 22 which surrounds a portion of the intermediate conduit 18 and which is followed in the fluid flow path by a cleaning chamber 24. This can be of several types. The intermediate conduit 18 in the cleaning chamber 24 has a perforated lower side 26 and is open at the top 28. A source of pneumatic pressure (not shown) can be attached to coupling 30 to force air through cleaning chamber 24 or a vacuum source (also not shown) can be attached to coupling 32 to draw air from the cleaning chamber 24. Preferably the cleaning chamber 24 adjacent the open top 28 of intermediate conduit 18 is provided with a dust collection means 36. If a vacuum source is connected to coupling 32, then coupling 30 would be an open valve, preferably provided with a filter (not shown) to prevent drawing unwanted material into the cleaning chamber 24. If a pressurized pneumatic source is connected to couping 30, coupling 32 is an exhaust valve.

The linear kinetic cell 22 is preferably of the type produced by the Electromagnetic Division of Enertec, Inc. of Kendallville, Ind. It is an electromagnet which surrounds a portion of the intermediate conduit 18 and, when energized, creates an electric field which neutralizes the static charge of dust 40 causing the dust to release from the primary particulate material 38.

Figure 4:
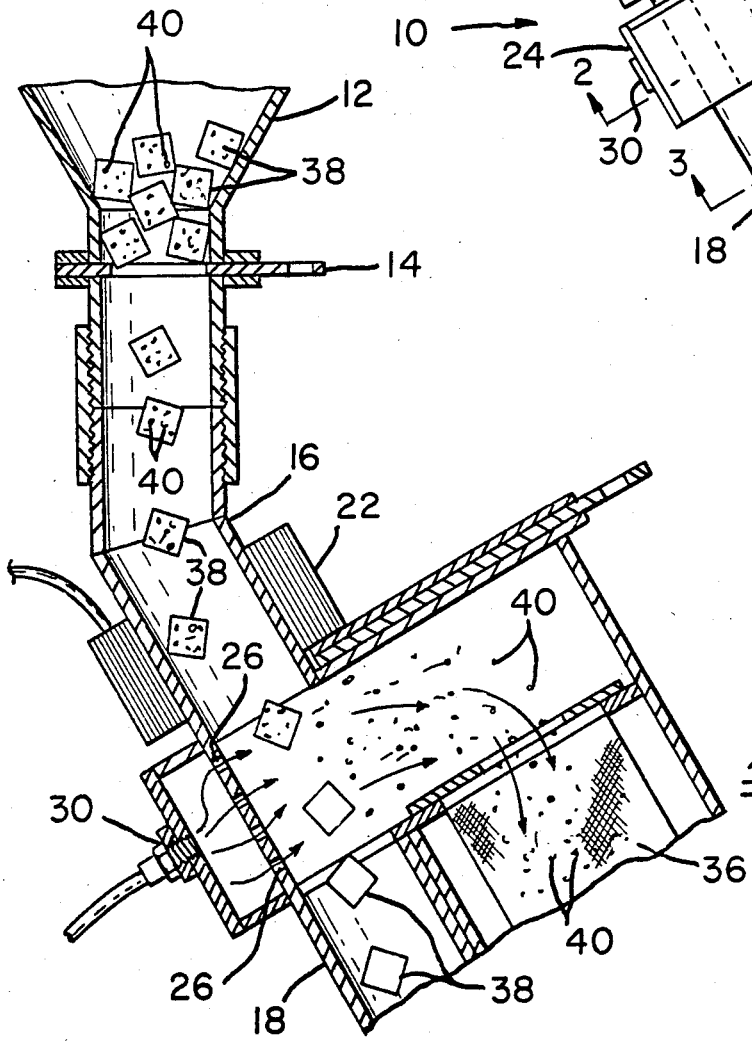
FIG. 4 is a schematic longitudinal section showing the operation of the present invention.

FIG. 4 shows schematically how the invention operates. The dirt laden particulate material 38 falls from the hopper 12 through the discharge control 14 and conduit 16. As the material passes through the linear kinetic cell 22, the ionization of the dust and impurities 40 carried on the particulate material 38 is neutralized so that when the material hits the cleaning chamber 24, the air currents (caused either by a pressure source or vacuum source) readily separate the dust 40 from the particulate material 38 which falls freely from the cleaning chamber 24 and out the discharge conduit 20.

Figure 5:
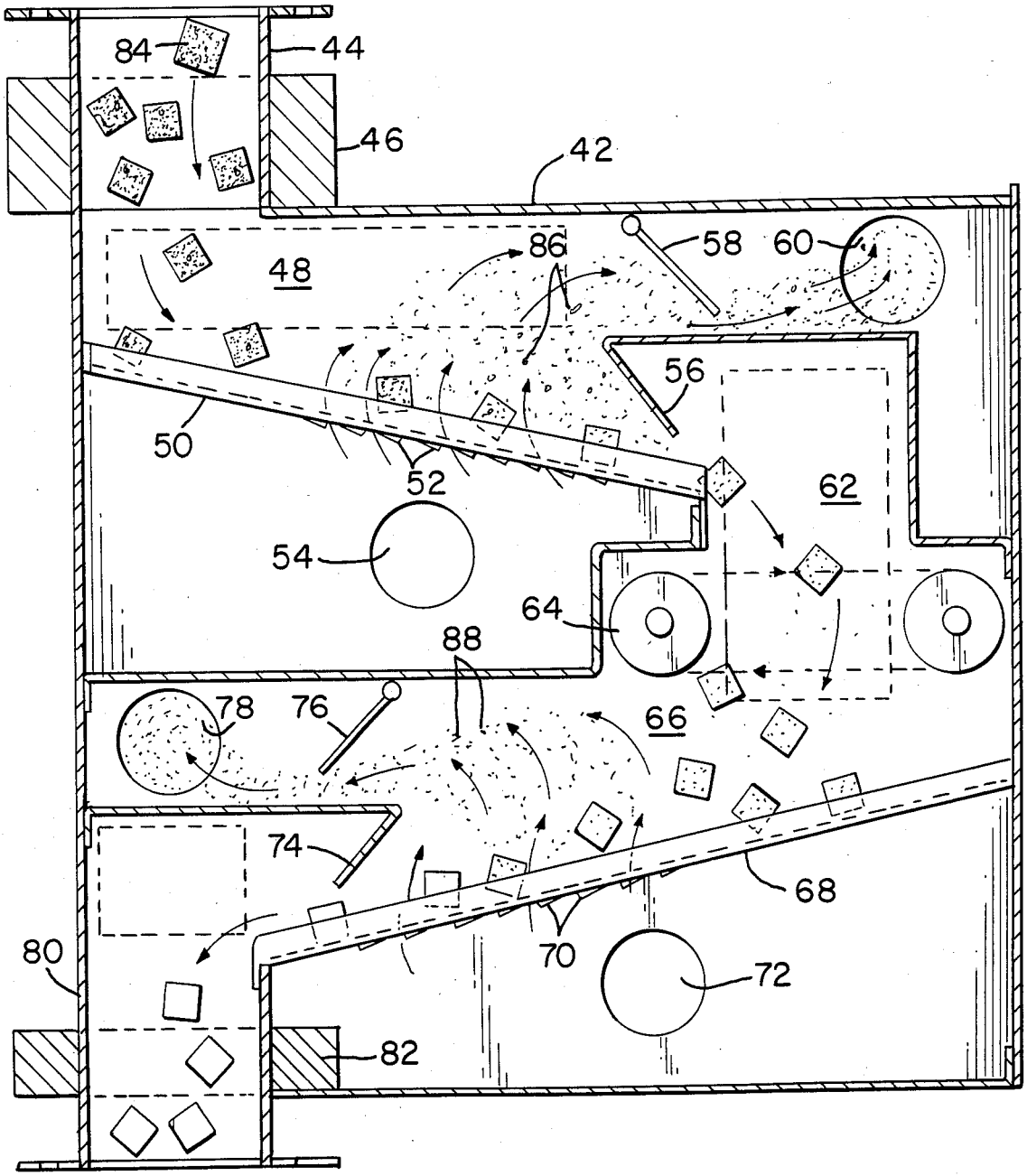
FIG. 5 is a longitudinal section through an alternate embodiment of the present invention.

An alternate embodiment, for more complete dedusting, is shown in FIG. 5. This embodiment includes a closed outer housing 42 with a substantially vertical inlet conduit 44 surrounded by a first linear kinetic cell 46. The inlet conduit 44 opens into first cleaning chamber 48 which has an inclined base plate 50 perforated by a plurality of holes 52. A first blower 54 is mounted below the base plate 50 and directs an air flow through the holes 52 normal to or slightly counter to the material flow. The outlet of the first cleaning chamber 48 is defined by baffle 56 and a one way shutter 58 leading to an exhaust port 60, which can include a dust collector (not shown). The outlet of the first cleaning chamber 48 leads to a second conduit 62, which includes a second linear kinetic cell 64. The second conduit 62 leads to a second cleaning chamber 66 with an inclined base plate 68 perforated by a plurality of holes 70. A second blower 72 is positioned below the base plate 68 and directs a second stream of air normal to or slightly counter to the material flow. The second cleaning chamber 66 has an outlet defined by baffle 74 and one way shutter 76 leading to an exhaust port 78, which can be connected to another dust collector (also not shown). An exit conduit 80 completes the material flow path and can be surrounded by a further linear kinetic cell 82.

The operation of this embodiment is similar to the first embodiment. The dust laden particulate material 84 drops into the inlet conduit 44 passing through the linear kinetic cell 46 which neutralizes the static electric charge causing the dust 86 to adhere to the particulate material 84. The particulate material enters the first cleaning chamber 48 where the first air flow separates the dust 86 from the particulate material 84 and carries the dust 86 out through the shutter 58 and exhaust port 60 where it can be collected. The particulate material 84, now cleaned of most of the dust 86, falls through the outlet to conduit 62 passing through the second linear kinetic cell 64. This further neutralizes the static electric charge of any remaining dust 86 allowing it to be separated from the particulate material 84, The second air flow from blower 72 separates the remaining dust 86 blowing it out through shutter 76 and exhaust port 78 to be collected. The cleaned particulate material 84 then falls freely from exit conduit 80.

It is to be understood that the linear kinetic cells 46 and 64 would be controlled in accordance with the composition of the primary particulate material 84. The air flows created by blowers 54 and 72 would be controlled in accordance with the size or mass of the particles. The air flows would not be so great a to impede the free fall of the particulate material through the subject deduster.

As a further alternative, the subject deduster can be provided with a streamer trap in the form of a chain conveyor moving tranversly across the particle flow. This has been schematically represented by the dashed arrows in second conduit 62 in the area of the second kinetic cell 64. Streamers of material, such as often appear in plastics material would become entangled in the conveyor and thus removed from the particle flow.

I claim:

1. A dedusting device for separating dust and similar unwanted debris adhering to particulate material and entrained therewith, said dedusting device comprising:

a series of chambers defining a substantially vertical feed path through which said particulate material falls by gravity, at least one of said chambers being a static electricity neutralization chamber having a linear kinetic cell surrounding a portion thereof; and the next adjacent down stream chamber being a cleaning chamber having a perforate lower side and an open upper side and being provided with means to cause a gaseous fluid flow substantially transverse to the particulate material flow whereby the electrically neutralized dust and debris is separated from the remaining particulate material.

2. A dedusting device according to claim 1 wherein said cleaning chamber includes vacuum means to generate said gaseous fluid flow.

3. A dedusting device according to claim 1 wherein said cleaning chamber includes a pressurized air source to generate said gaseous fluid flow.

4. A dedusting device according to claim 1 wherein said linear kinetic energy cell creates an electric field through which said particles pass to substantially neutralize the electric charge causing said dust to adhere to the particulate material.

5. A dedusting device according to claim 1 wherein said neutralization and cleaning chambers are arranged in a series of pairs to achieve complete cleaning of the particulate material.

6. A dedusting device according to claim 1 further comprising dust collecting mean associated with each said cleaning chamber.

7. A dedusting device according to claim 1 further comprising streamer removal means formed by an endless chain conveyor moving transversely through a vertical section of said feed path whereby streamers will become entangled in the chain and removed from the particle flow.

* * * * *